United States Patent [19]

Sinha et al.

[11] Patent Number: 4,823,586

[45] Date of Patent: Apr. 25, 1989

[54] CONFORM PRODUCT THERMOMECHANICAL TREATMENT

[75] Inventors: Uday K. Sinha; E. Henry Chia, both of Carrollton, Ga.

[73] Assignee: Southwire Company, Carrollton, Ga.

[21] Appl. No.: 140,164

[22] Filed: Dec. 31, 1987

[51] Int. Cl.[4] ..... B21C 31/00

[52] U.S. Cl. ..... 72/257; 72/262; 72/364

[58] Field of Search ..... 72/253.1, 257, 262, 72/364; 148/11.5 A

[56] References Cited

U.S. PATENT DOCUMENTS

| | | | |
|---|---|---|---|
| 3,364,707 | 1/1968 | Foerster | 72/253.1 |
| 3,368,377 | 2/1968 | Hirayama et al. | 72/342 |
| 3,774,431 | 11/1973 | Stromblad et al. | 72/257 |

FOREIGN PATENT DOCUMENTS

| | | | |
|---|---|---|---|
| 220212 | 12/1984 | Japan | 72/253.1 |
| 2031773 | 4/1980 | United Kingdom | 72/257 |

*Primary Examiner*—Lowell A. Larson
*Attorney, Agent, or Firm*—Wigman & Cohen

[57] ABSTRACT

Apparatus for continuously extruding material includes a moving member and a stationary member forming a passageway therebetween for frictional feeding of the material to be extruded under pressure into the passageway. An abutment in the passageway forms a barrier to the material being fed therein, whereby the forces on the material heat it and cause it to yield. The heated material flows into an extrusion chamber adjacent to the abutment and is extruded from a die in a wall of the chamber. A cooling system provides first and second phases of quenching the extruded product separated by an interval of self-annealing to limit the surface grain size and the hardness of the extruded product. The product is subjected to the first phase of quenching immediately as it exists the die, to maintain the temperature of the extruded product at a desired fixed level at a selected point along the flow path of the extruded product downstream of the die.

24 Claims, 1 Drawing Sheet

CONFORM PRODUCT THERMOMECHANICAL TREATMENT

FIELD OF THE INVENTION

The present invention relates generally to extrusion processes and apparatus, and more particularly to the type of extrusion apparatus generally known as conform machines designed to permit continuous extrusion of a feedstock material into various shapes and sizes.

DESCRIPTION OF THE PRIOR ART

In the typical conform extrusion machine, solid feedstock such as an aluminum rod or other solid or powdered material to be extruded is fed in an unheated state into the machine along a rotating wheel. The wheel has an endless groove at its periphery to receive the feedstock. A portion of the circumference of the wheel, typically about one-quarter of the length thereof, is maintained in close contact with a fixed heavy metal block known as an extrusion shoe. At the end of the contacting portion, a blocking abutment that enters the groove obstructs the path of the feedstock, preventing it from being carried farther along the groove in the rotating wheel. As the extrusion material is pushed against the abutment by the frictional force exerted by the continuously rotating wheel, sufficient force is produced to extrude the material through a die retained at the end of a chamber in the shoe adjacent to the blocking abutment.

The advantages of the conform extrusion machine over heretofore conventional extrusion apparatus include the provision of a theoretically continuous extruding process, with attendant simplification of subsequent handling techniques and elimination of billet discards, and the use of cold solid or powdered feedstock with avoidance of any need to preheat the material prior to extrusion thereof. Examples of prior art conform extrusion apparatus of the aforementioned type are described in U.S. Pat. Nos. 3,765,216 to Green and 4,055,979 to Hunter et al.

Considerable heat is generated by the enormous frictional resistance and resulting axial stress encountered by the feedstock as it is fed along the groove by the rotating wheel as a consequence of the close contact of the latter with the extrusion shoe. The frictional force and attendant heat cause the feedstock to yield and flow through the die. In a typical process, the extruded product may be fed into a water quench tank located some five to ten feet from the exit die. It has been found that such prior art conform machines produce extruded products having non-uniform grain size and large surface grains which cause "orange peel" of the product when it is subjected to mechanical bending or other similar high stress working operations. Furthermore, products of the conventional conform process have been found to exhibit occasional blisters on the surface and relatively soft material of non-uniform hardness.

Accordingly, it is a principal object of the present invention to provide a conform extrusion machine for producing extruded products with uniform small grain size and improved mechanical properties.

In the copending U.S. patent application of U.K. Sinha et al. entitled "Improved Conform Extrusion Process and Apparatus" Ser. No. 140,165 filed 12-31-87, assigned the same assignee as the present invention and hereinafter referred to as the copending Sinha et al. application, it is observed that an expansion chamber may be provided in the extrusion shoe, located adjacent to the blocking abutment and upstream of the die, to allow extrusion of product of larger cross-section than the feed material in the conform extrusion process. The frictional forces on the feed material are higher along the extrusion shoe, which is fixed relative to the moving material, than along the grooved rotating wheel against which the material is moved. As a result, the temperature of the feed material is higher in the region adjacent to the shoe than in the region adjacent to the rotating wheel. In the conformed product (i.e., the extruded product), the portion subjected to the higher temperature during the extrusion process has a larger grain size. As a result of the unusual orientation of the conform machine, the lower region of the feed material experiences the higher temperature and, thus, as it leaves the die, the lower portion of the conform product has larger grains than the upper portion of the product.

The surface of the conform product recrystallizes more rapidly than the product interior because of the hardening process. Additionally, because of the high exit temperature of the conform product as it leaves the die, it undergoes a spontaneous secondary recrystallization along the edges of its surface, with consequent further grain growth. The resulting product suffers seriously inconsistent grain size and attendant structural deficiencies.

The copending Sinha et al. application discloses an improved conform machine employing special cooling systems to enhance the structural properties of the final product, and more specifically, which allow the extrusion process to be carried out at a preselected desired temperature and which maintain the material in the extrusion chamber at a uniform temperature. In addition, the conform apparatus described therein is provided with plural cooling systems for maintaining a preset extruding temperature and for inhibiting secondary recrystallization of the product. To that end, the conform extrusion apparatus disclosed in the copending Sinha et al. application employs a first cooling system for maintaining a desired temperature in the extrusion chamber of the apparatus. The first cooling system provides means at both sides of the extrusion chamber for sensing the temperature thereat, a coolant supply stream to both sides of the chamber, and control means responsive to changes in the temperature at either side relative to a predetermined extrusion chamber temperature for varying the flow of coolant at each side respectively. In this manner, the temperature of the material is maintained substantially uniform throughout the extrusion chamber, to produce a conform product having substantially uniform small grain structure and consequent improved mechanical properties.

According to another aspect of the invention disclosed in the copending Sinha et al. application, a second cooling system is provided to cool the conform product as it exits the die, and thereby to inhibit secondary recrystallization and grain growth at the surface of the product. That application further observes that in conventional extrusion processes which do not use the conform technique, it is customary to provide cooling within the die. However, the heating problem in the conform process is different from that encountered in the conventional extrusion process and requires a vastly different solution which takes into account the presence of localized hot spots contributing to the different grain sizes in the final product. Prior art proposals suggest the use of various types of cooling systems in the type of conform extrusion apparatus which uses entry feed material in molten rather than solid or powdered form, but in those instances the proposed cooling has been for purposes of solidifying the molten material. Examples of this may be found in U.S. Pat. No. 4,393,917 to Fuchs, Jr., and European Patent Application Publication No. EP 0110653.

In contrast to the prior art proposals, the invention disclosed in the copending Sinha et al. application provides a cooling system for conform extrusion apparatus by which the extrudable material is maintained at uniform temperature at both sides of the extrusion chamber, and the conform product is subjected to cooling immediately as it is extruded from the die. Although the latter fast cooling at the die exit—by spray cooling the conformed product as it exits the die, for example—serves to restrict the grain growth, it has been found to increase the hardness of the product. In some instances, this increase in product hardness may exceed product specifications.

It is another object of the present invention to provide a process and apparatus for control of both surface grain size and hardness of the conform product.

SUMMARY OF THE INVENTION

According to the present invention, the conform product is completely quenched in water contained in an in-line quench tank as the product is extruded from the die. In particular, the quench tank is controlled such that the product exiting the tank is maintained at a predetermined fixed elevated temperature, by way of example, approximately 850° F., in the preferred embodiment. The maintenance of the temperature of the product leaving the quench tank is achieved by controlling the flow of water into the tank. According to the preferred embodiment, the flow rate of water into and out of the tank is microprocessor-controlled in accordance with several factors including temperature of the product entering the tank, temperature of the product leaving the tank (desired to be maintained), production rate of the product, temperature change ($\Delta t$) of the water flowing through the tank, and product material involved.

According to another aspect of the invention, following the exit of the product from the quench tank, it is subjected to a second cooling phase after a delay period which is selected to be sufficient to provide self-annealing to reduce the hardness of the product to a desired level. In the preferred embodiment, the second cooling phase is provided by another quench tank into which the product is fed after the selected delay period. The point of entry for the product into this second quench tank is at a distance from the exit point of the first quench tank which depends upon the production rate of the product (and, thus, the rate at which it is fed from the die), the material of which the product is composed, and the time required for the selfannealing. In the specific case of conform product of aluminum, hardness achieved using a process and apparatus conforming to the preferred embodiment of the invention was HRH-27 (Rockwell "H" hardness), well within the specified maximum limit for hardness for the product; and well below the hardness experienced for product produced by a process which subjected it to spray cooling upon exiting the die, wherein the hardness exceeded HRH-30.

It will be observed, therefore, that the present invention provides conform product having hardness within desired limits, together with the further advantages of improved surface grain structure, fine grain size which resists "orange peel" during cold processing, and suppression of the tendency toward blister formation.

BRIEF DESCRIPTION OF THE DRAWINGS

The above and still further objects, features, and attendant advantages of the present invention will become apparent from a consideration of the following detailed description of a preferred embodiment thereof, taken in conjunction with the accompanying drawings in which.

DESCRIPTION OF THE PREFERRED EMBODIMENT

Figure 1:
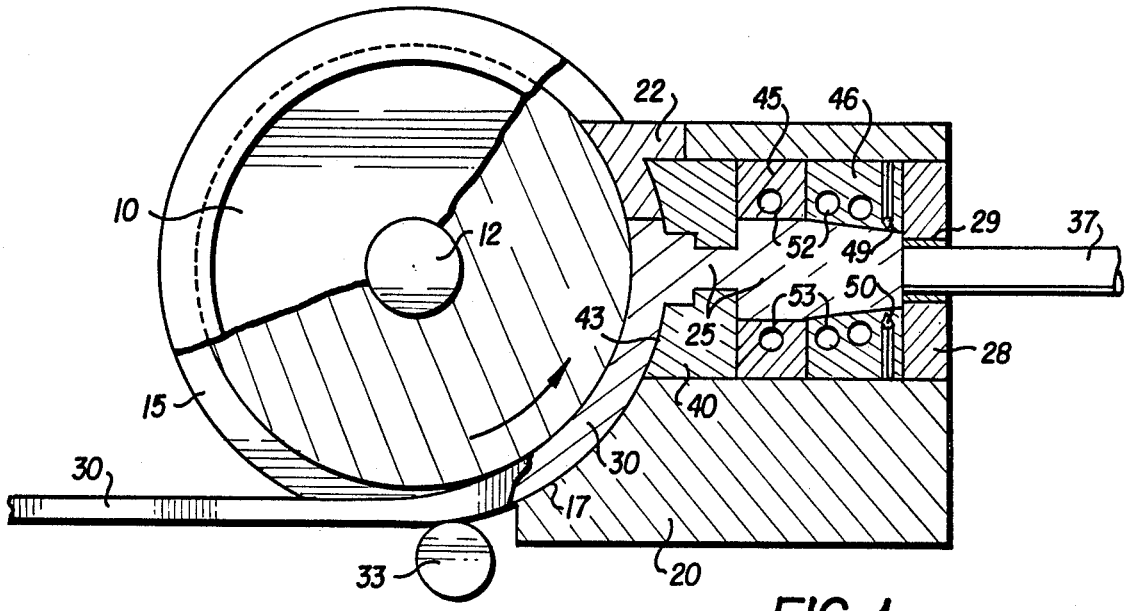
FIG. 1 is a partial sectional side elevation of a conform extrusion apparatus including a portion of the temperature regulating system for the extrusion chamber according to the copending Sinha et al. application.

Referring now to FIG. 1, an apparatus for continuously extruding material into a desired conform product includes a wheel 10 mounted for rotation on a shaft 12. Wheel 10 has an endless channel or groove 15 suitably formed in its circumferential edge 17. The wheel 10 rotates in close proximity to an extrusion shoe 20 which remains stationary relative to the wheel. A channel blocking abutment 22 is affixed to shoe 22 and enters the channel 15 in close proximity to the walls thereof, so that the wheel is free to rotate but a barrier is formed by abutment 22 to anything that may be carried in that passageway. The extrusion shoe 20 includes an extrusion chamber 25 disposed adjacent to the blocking abutment 22. A die block 28 at the end of the extrusion chamber forms a wall of the chamber and retains a die 29 therein to permit material to be extruded therethrough into a desired shape.

The apparatus thus far described is completely conventional structure in conform extrusion machines of the prior art. In operation, a solid feedstock or feed material 30, which may be an aluminum rod, for example, of a size adequate to be received within the channel 15, is fed into the apparatus with the assistance of a coining roll 33. The material is fed under pressure in any conventional manner (not shown) such that it frictionally engages the shoe 20 and the walls of the channel 15 as the wheel 10 rotates in a counterclockwise direction, as viewed in FIG. 1. The material eventually encounters the blocking abutment 22 in channel 15, typically located about one-quarter of the circumference of the wheel from the entry point for the material 30. Under the frictional forces and the pressure exerted on the feed material, and the accompanying axial stress set up in the material, it will begin to yield at a point which depends on the heat generated by the process and the yielding strength of the particular material used.

The yielding material commences to flow and is thereby forced into the extrusion chamber 25 and ultimately extruded through the die 29, to produce the desired conform product 37. If desired, an expansion chamber may be used with an appropriately larger die, to permit extrusion of product having a cross-section larger than the cross-section of the feed material. In any event, considerable heat is generated in the process of continuous extrusion by the conform apparatus. As observed in the copending Sinha et al. application, the typical orientation for conform machines of the prior art results in the feed material experiencing greater frictional force along the stationary member side of the machine; that is, on the side toward the extrusion shoe 20. The portion of the material encountering this higher frictional force is heated to a higher temperature than that portion of the material subjected to lower frictional force. Accordingly, the flowable material in the lower part of the extrusion chamber is typically at a substantially higher temperature than that in the upper part of the chamber. As a result, the grain size of the extruded product is irregular, with the larger grains at the lower part of the product relative to the size of the grains in the upper part, and with a concomitant deleterious effect on the mechanical properties of the final extruded product.

According to the invention disclosed in the copending Sinha et al. application, the conform extrusion apparatus is provided with a system for controlling the temperature of the flowable material in the extrusion chamber to remove the undesired hot spots. That system will be described briefly herein for the sake of convenience, and while the inclusion of that system in the conform apparatus is desirable it should be noted that its use is not essential to the present invention. In any event, the disclosure of the copending Sinha et al. application is hereby incorporated by reference into this specification. The extrusion chamber 25 may be integrally formed in the extrusion shoe 20 by machining the latter, or it may be provided in a separate component fitted into or on the shoe, to maintain the above-described relationship of the chamber to the blocking abutment 22 in the channel 15.

As shown in FIG. 1, such a component is an expansion chamber member 40 having an arcuate surface 43 conforming to an arc at the circumference of rotatable wheel 20 and confronting the channeled edge of the wheel when member 40 is fastened to the shoe 20. The extrusion chamber (expansion chamber) 25 is formed in part in chamber member 40 and in further part in a pair of feeder blocks 45,46 which are also fitted and secured in the shoe. That portion of chamber 25 provided by the openings in the feed blocks 45,46 may be larger than the chamber portion in member 40, and the portion in feeder block 46 may be tapered down toward the die block 28 forming the end wall of the extrusion chamber.

Thermocouples 49 and 50 are housed at or near the longitudinal surface of chamber 25 in feeder block 46, preferably close to the die block 28. Each of the thermocouples is formed in a conventional manner from a pair of dissimilar thermoelectric materials, and each generates an electrical signal representative of the temperature at the junction of the dissimilar materials. The thermocouples are electrically insulated from the feeder block and from each other, and have their respective junctions positioned as close as practicable to the surface of chamber 25 to detect the temperature of feed material in the chamber or of that portion of the feeder block immediately adjacent to the chamber. The location of the thermocouples next to the die block assures that the temperature of the material in the extrusion chamber is sensed at a point or points reasonably close to the point from which the material is extruded from the chamber to form the desired conform product 37. Thermocouple 49 is positioned at the upper side of the extrusion chamber 25 and thermocouple 50 is positioned at the lower side of the chamber to sense the temperature of regions of the material which are typically at the lowest and highest temperatures, respectively, in the selected portion of the chamber.

Feeder blocks 45,46 are provided with ducts or passageways 52 and 53 therethrough, respectively running adjacent to the upper and lower sides of chamber 25 so as to be in heat exchange relationship principally with those portions of the chamber. Each of the ducts is adapted to carry a coolant fluid therethrough, such as water or liquid nitrogen. Ducts 52 are joined together at a single inlet having an electrically controlled valve 56, such as a solenoid valve (not shown) to regulate the flow of coolant fluid therethrough. A corresponding but completely separate cooling system arrangement is provided for lower ducts 53 which re joined at a single inlet having an electrically controlled flow regulating valve (not shown). At the opposite ends of the upper and lower ducts, suitable conventional means are provided for recirculating the coolant fluid back to the source thereof.

Each of the thermocouples 49,50 is electrically connected to control circuitry not shown herein, but an embodiment of which is shown and described in detail in the copending Sinha et al. application. The circuitry may include sampling and digitizing circuitry to condition the electrical signal outputs of the thermocouples, which are representative of the temperature values at the respective thermocouple junctions, for control purposes. For example, a microprocessor may be used to compare the sensed temperature signal value from thermocouple 50 to the signal value derived from thermocouple 49 and to null the difference by generating an output which is converted to an analog signal for that purpose. Since the temperature of the material in the lower region of the extrusion chamber attributable to the conform extrusion process is almost invariably higher than the temperature of the material in the upper region of the chamber, the analog control signal derived from the microprocessor may be used to control the lower valve to allow flow of the coolant fluid through ducts 53 until the temperature sensed by thermocouple 50 is reduced to the temperature sensed by thermocouple 49.

The extruded product 37 resulting from the provision of a substantially uniform temperature of material at the point of extrusion has uniformity of grain size throughout and consequent improved mechanical properties. However, the extruded product undergoes secondary recrystallization at and near its surface, attributable to the high exit temperature of the product, causing some grain growth in the affected region near the product surface. According to a feature of the invention disclosed in the copending Sinha et al. application, a second system is provided for spray cooling the product as it is extruded from the die, to inhibit the secondary recrystallization. That purpose is well served, but the extruded product has been found to undergo some increase in hardness, and in certain instances, may be at an undesired level of hardness.

Figure 2:
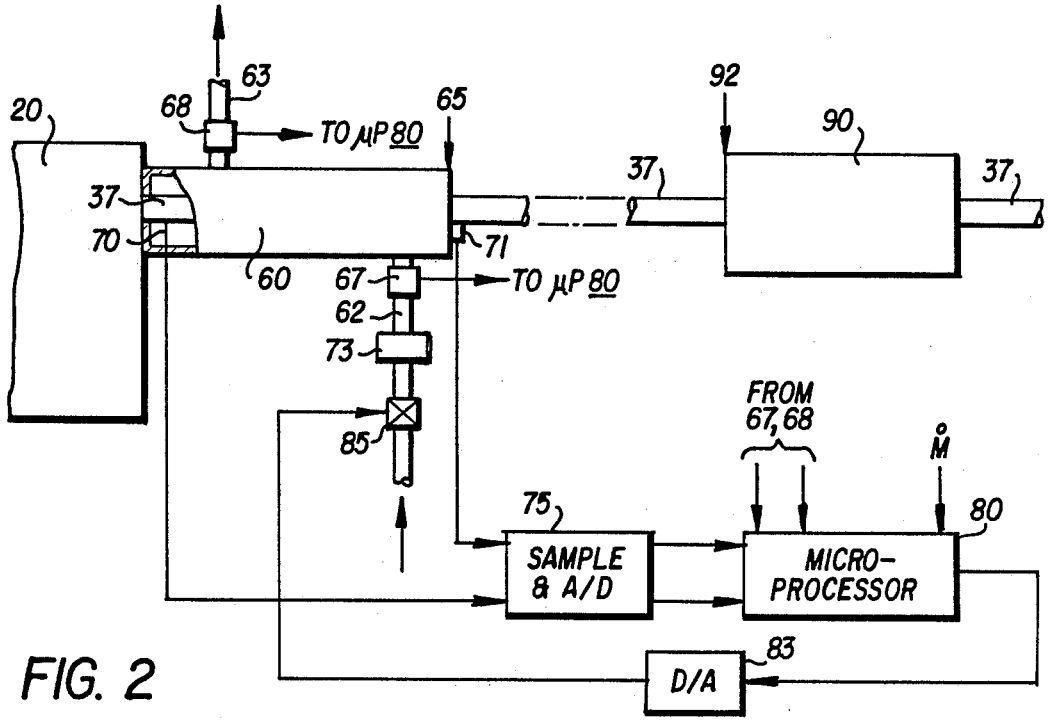
FIG. 2 is a side elevation of a preferred embodiment of a cooling system for the extruded conform product according to the present invention, for use with conform extrusion apparatus of the type such as that shown in FIG. 1, and schematically illustrating the control system for the cooling system.

Referring now to FIG. 2, there is shown a preferred embodiment of a cooling or temperature control system for the extruded conform product according to the present invention. An in-line quench tank 60 is positioned at the outlet of die 29 in abutting relationship to the extrusion shoe 20 and/or die block 28, to receive the extruded conform product 37 as it exits from the die. The conform product passes through quench tank 60 as the product moves along its flow path or feed path. The quench tank has an inlet conduit 62 and an outlet conduit 63 for water flow therethrough. The purpose of this quenching, which is a first phase of cooling the product, is to maintain the temperature of the product at a predetermined fixed temperature level at the point 65 of egress of the product from the tank.

To that end, thermocouples 67,68 are positioned at the inlet and outlet conduits 62,63 at respective points at or close to the actual entry and discharge points for the water to and from the quench tank 60. These thermocouples serve to detect the temperature of the water entering and leaving the tank. Third and fourth thermocouples or other suitable temperature sensors 70,71 are positioned at the conform product points of entry into and egress from the quench tank, respectively, to detect the temperature of the product at those points. A conventional flow meter 73 may be positioned at the inlet conduit 62 to measure the rate of flow of the water therethrough. Of course, under normal conditions the flow rate of the water discharged from the quench tank will be equal to the flow rate of the water discharged from the quench tank.

Preferably, the electrical signals generated by the thermocouples as representative of the respective temperatures at the sensing points, are sampled at a suitable clock rate and converted to digital data in a conventional manner, as by use of sampling and A/D converter circuitry 75, for entry into a microprocessor 80. In addition, digital information indicative of the production rate of the conform product is fed into the microprocessor for use in the first cooling phase, to maintain the desired fixed temperature of the extruded product at the point of egress 65 from quench tank 60.

The rate of water flow through the quench tank for the latter purpose is determined by the microprocessor according to the following expression:

$$W = \frac{\mathring{M}\, C_P (T_2 - T_1)}{8.345\ \Delta t}$$

where W is the flow rate of the water through the quench tank in gallons per minute, $\mathring{M}$ is the production on rate of the conform product in pounds per minute, $C_p$ is the specific heat of the material of which the conform product is composed (i.e., the feed material to the conform extrusion apparatus), $T_2$ is the temperature of the conform product at the point of entry to the quench tank, $T_1$ is the temperature of the conform product at the point of egress from the quench tank, $\Delta t$ is the rise in temperature of the water between the inlet and the outlet of the quench tank. And 8.345 is the weight of water in pounds per gallon.

In an exemplary process performed using the preferred embodiment as thus far described, it was found that under steady state conditions, in which the temperature ($T_1$) of the conform product leaving the quench tank at point 65 was maintained at a desired fixed level of 850° F., $T_2$ was 950° F., $\Delta t$ was 10° F., $\mathring{M}$ was 16.7 lb/min., and the conform product was aluminum, the required flow rate of water through quench tank 60 was about five gallons per minute.

To regulate the temperature of the emerging product at the desired level, the microprocessor produces an output indicative of the water flow rate in accordance with the above mathematical expression. This digital output is converted to an analog signal, as by a D/A converter 83, amplified if necessary, and finally delivered to an electrically operated flow valve 85, such as an adjustable orifice solenoid valve, in the inlet conduit 62 for the quench tank to control the flow rate of the water therethrough. It is clear from the mathematical expression used to control the exit temperature of the product, that the maintenance of the desired predetermined temperature at point 65 requires a faster rate of flow as the temperature difference between the tank entry point and egress point for the product becomes larger. In particular, the water flow rate required varies directly with that temperature difference and with the production rate of the product, and varies inversely with the temperature change ($\Delta t$) for the incoming and outgoing water of the tank.

A second phase of cooling of the product is provided by a second quench tank 90 in the flow path of the extruded product. The point of entry 92 to the second quench tank is located downstream of the point of egress 65 of the product from the first tank, which itself is downstream of the die 29 in the product flow path. The distance between these two points is selected to be sufficient to allow the extruded product to self-anneal as it moves through that distance. For example, aluminum conform product at the above-mentioned production rate and egress temperature at point 65 was found to complete a self-annealing process in about a 30 second time interval, which reduced the product hardness to approximately HRH-27. This was also found to provide more uniform and reproducible hardness of the conform product. In the present example of the process, the distance between point 65 and point 92 is sufficient to allow 30 seconds of travel time therebetween for a given point on the product, to allow the desired self-annealing.

In addition to the improvements in product hardness, including uniformity and reproducibility, the foregoing process provides cooling of the product sufficient to inhibit grain growth. Therefore, a fine grained product is produced which resists "orange peel" during further processing.

Although a preferred embodiment has been described herein, it will be apparent to those of ordinary skill in the art to which the invention pertains that variations and modifications of the described embodiments may be made without departing from the spirit and scope of the invention. Accordingly, it is intended that the invention be limited only to the extent required by the appended claims and applicable rules of law.

What is claimed is:

1. In an apparatus for continuously extruding material into a desired conform product by feeding material to be extruded against a rotating extrusion wheel cooperating with a fixed member to define a groove within which the material is frictionally carrier to a stationary abutment blocking said groove and is thereupon forced in a heated state into an extrusion chamber and through a die to produce the conform product, the improvement comprising first means for cooling the conform product immediately upon exit from the die to maintain the product at a predetermined uniform elevated temperature upon egress thereof from the first cooling means, and second means for cooling the product after a delay time interval sufficient to produce self-annealing of the product following egress thereof from said first cooling means.

2. The apparatus according to claim 1 wherein said material is aluminum and said predetermined uniform elevated temperature is about 850° F.

3. The improvement according to claim 1, wherein said first cooling means comprises a first quench tank with entry and exit points for flow of cooling fluid therethrough, and means for controlling the flow rate of the cooling fluid in accordance with the predetermined uniform elevated temperature desired for the product upon egress from said first quench tank.

4. The improvement according to claim 3, wherein said second cooling means comprises a second quench tank having a point of entry for said product disposed from the point of egress of said product from the first quench tank by a distance sufficient to provide said delay time interval based on the feed rate of said product.

5. The improvement according to claim ,2., wherein said means for controlling the flow rate of the cooling fluid comprises a microprocessor responsive to the temperature of the cooling fluid entering and leaving said first quench tank, the feed rate of said product and the desired predetermined uniform elevated temperature of said product upon egress thereof from said first quench tank, to control said flow rate of the cooling fluid accordingly.

6. The improvement according to claim 5, wherein said cooling fluid is water.

7. The improvement according to claim 6, wherein said means for controlling controls the flow rate of water through said first quench tank according to the expression:

$$W = \frac{\mathring{M}\, C_P (T_2 - T_1)}{8.345\ \Delta t}$$

where W is the flow rate of the through the first quench tank in gallons per minute, $\mathring{M}$ is the production rate of the conform product in pounds per minute, $C_p$ is the specific heat of the material of which the conform product is composed (i.e., the feed material to the conform extrusion apparatus), $T_2$ is the temperature of the conform product at the point of entry to the first quench tank, $T_1$ is the temperature of the conform product at the point of egress from the first quench tank, $\Delta t$ is the rise in temperature of the water between the inlet and the outlet of the first quench tank and 8.345 is the weight of water in pounds per gallon.

8. In combination with apparatus for continuously extruding product by feeding material to be extruded onto a rotating extrusion wheel cooperating with a stationary member to define a passageway within which the material is frictionally moved under pressure against a blocking abutment and forced via an extrusion chamber through a die to produced the extruded product, a cooling system for controlling the surface grain size and the hardness of the extruded product, said cooling system comprising means for regulating the temperature of said extruded product at a preselected fixed elevated temperature below the temperature at which said extruded product exits from said die, wherein said regulated temperature is determined at a first selected point downstream of said die, and means for quenching said extruded product at a second selected point further downstream of said first selected point, wherein the distance between said first and second selected points is sufficient to allow self-annealing of said extruded product therebetween based on the extrusion rate of said extruded product.

9. The apparatus according to claim 8, wherein said material is aluminum and said preselected fixed elevated temperature is about 850° F.

10. The cooling system according to claim 8, wherein said temperature regulating means comprises an in-line quench tank for receiving the product as it is extruded from the exit point of said die, and means for controlling the flow of coolant through said in-line quench tank.

11. The cooling system according to claim 10, wherein said quenching means comprises a second quench tank for receiving the extruded product downstream of said in-line quench tank.

12. The cooling system according to claim 10, wherein said means for controlling comprises a microprocessor.

13. A process of continuously extruding material comprising the steps of feeding the material to be extruded under pressure along a passageway between a moving member and a stationary member to frictionally urge the material against an abutment closing the passageway, wherein the pressure and friction heat the material and cause it to yield, thereby forcing said material into an extrusion chamber adjacent to said abutment and through a die to form the desired extruded product, quenching the extruded product as it exits the die to maintain the temperature of the extruded product at a desired fixed level at a selected point along the flow path of the extruded product to self-anneal as it moves along said flow path, and quenching the extruded product again after it has self-annealed.

14. The process according to claim 13, wherein said material is aluminum and the desired fixed level of the temperature of the extruded product at said selected point along the flow path is about 850° F.

15. The process according to claim 13, wherein the first-mentioned quenching of the extruded product includes the steps of passing the extruded product through a quench tank immediately as the product is extruded from the die, and regulating the flow of cooling fluid through the quench tank to achieve said desired fixed temperature level for the extruded product upon exit thereof from the quench tank.

16. The process according to claim 15, wherein said regulating step includes the steps of sensing the temperature of the cooling fluid and the extruded product at the entry and exit points of the quench tank and controlling the flow rate of cooling fluid through the quench tank for a given production rate of the extruded product in response to the sensed temperatures.

17. The process according to claim 15, including the step of determining the production rate of the extruded product.

18. The process according to claim 17, wherein said cooling fluid is water and said controlling step controls the flow rate of water to the quench tank according to the expression:

$$W = \frac{\mathring{M}\, C_P (T_2 - T_1)}{8.345\ \Delta t}$$

where W is the flow rate the water through the quench tank in gallons per minute, $\mathring{M}$ is the production rate of the conform product in pounds per minute, $C_p$ is the specific heat of the material of which the conform product is composed (i.e., the feed material to the conform extrusion apparatus), $T_2$ is the temperature of the conform product at the point of entry to the quench tank, $T_1$ is the temperature of the conform product at the point of egress from the quench tank, $\Delta t$ is the rise in temperature of the water between the inlet and the outlet of the quench tank and 8.345 is the weight of water in pounds per gallon.

19. Conform apparatus for continuously extruding material, comprising a moving member and a stationary member forming a passageway therebetween for frictional feeding of the material to be extruded, an abutment closing the passageway to form a barrier to the material being fed therein, whereby the forces on the material heat it and cause it to yield, an extrusion chamber coupled to said abutment for accepting the heated material, die means in a wall of said chamber for extruding the material therefrom, and control means for providing first and second phases of quenching the extruded product separated by an interval of self-annealing of the extruded product to limit the surface grain size and the hardness of the extruded product.

20. The apparatus according to claim 19, wherein said control means includes a quench tank for receiving the extruded product at the point of exit thereof from said die means for said first quenching phase, and means for regulating the flow of water through said quench tank to lower the temperature of the extruded product to a desired fixed level which is elevated relative to the ambient temperature outside said quench tank.

21. The apparatus according to claim 20, wherein the material is aluminum and the desired fixed level of elevated temperature of the extruded product is about 850° F.

22. A process of continuously extruding metal comprising the steps of feeding the metal to be extruded under pressure along a passageway such that the pressure and friction heat the metal and cause it to yield, forcing the metal into an extrusion chamber and through a die to form an extruded metal product at a first elevated temperature, initiating quenching of the extruded product as it exits the die at a first quenching station, terminating the quenching of the extruded product at a second predetermined elevated temperature, after terminating the quenching step at the first quenching station passing the continuously extruded metal product through a substantially non-quenching environment to a second quenching station, quenching the extruded metal product at the second quenching station, self-annealing the extruded metal product during the time interval from the termination of the quenching of the extruded product at the first quenching station to the commencement of quenching at the second quenching station whereby the surface grain size and hardness of the extruded product are limited.

23. The process according to claim 22, wherein said metal is aluminum and said second predetermined elevated temperature is about 850° F.

24. The process according to claim 23, wherein said extruded aluminum product is aluminum rod.

* * * * *